US007071434B1

(12) United States Patent
McConnell et al.

(10) Patent No.: US 7,071,434 B1
(45) Date of Patent: Jul. 4, 2006

(54) BUTTON AND LIGHT PIPE MECHANISM AND ASSEMBLY

(75) Inventors: John E. McConnell, Ann Arbor, MI (US); Brian R. Masters, Hartland, MI (US); Bruce Pierik, Hazel Park, MI (US); John Stack, Shelby Township, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/163,108

(22) Filed: Oct. 5, 2005

(51) Int. Cl.
*H01H 13/04* (2006.01)

(52) U.S. Cl. ..... 200/310; 200/317; 200/343

(58) Field of Classification Search ..... 200/5 A, 200/517, 310–314, 341–345; 341/22; 345/168, 345/169; 400/490–496
See application file for complete search history.

(56) References Cited

U.S. PATENT DOCUMENTS

| | | | | |
|---|---|---|---|---|
| 4,315,114 | A * | 2/1982 | Monti, Jr. | 200/5 A |
| 4,360,722 | A * | 11/1982 | Georgopulos | 200/314 |
| 4,613,736 | A * | 9/1986 | Shichijo et al. | 200/317 |
| 4,997,998 | A * | 3/1991 | Bauer | 200/345 |
| 5,012,054 | A * | 4/1991 | Rada et al. | 200/314 |
| 5,927,483 | A * | 7/1999 | Yamada | 200/343 |
| 6,080,940 | A * | 6/2000 | Rice | 200/5 A |
| 6,388,559 | B1 | 5/2002 | Cohen | |
| 6,492,605 | B1 * | 12/2002 | Iida | 200/343 |
| 6,555,774 | B1 * | 4/2003 | Nielsen | 200/343 |
| 6,964,532 | B1 * | 11/2005 | Lu | 400/490 |
| 2005/0002170 | A1 | 1/2005 | Jacobs et al. | |
| 2005/0017948 | A1 | 1/2005 | Nguyen et al. | |

* cited by examiner

*Primary Examiner*—Michael A. Friedhofer
(74) *Attorney, Agent, or Firm*—Brooks Kushman P.C.

(57) ABSTRACT

A button and light pipe mechanism and assembly. The button and light pipe mechanism includes a unitary body having a frame, a first arm, a button, and a light pipe. The first arm is configured to flex when sufficient force is exerted on the button.

20 Claims, 2 Drawing Sheets

BUTTON AND LIGHT PIPE MECHANISM AND ASSEMBLY

BACKGROUND OF THE INVENTION

Field of the Invention

The present invention relates to a button and light pipe mechanism and an assembly having a button and light pipe mechanism, such as an interior trim assembly for a vehicle.

SUMMARY OF THE INVENTION

In at least one embodiment of the present invention, a button and light pipe mechanism is provided. The button and light pipe mechanism includes a unitary body having a frame, a first arm, a button, and a light pipe. The frame at least partially defines an opening. The first arm extends from the frame toward the opening and has a distal end. The button extends from the distal end. The light pipe extends from the frame and is disposed at least partially in the opening between the button and the frame. The first arm is configured to flex when sufficient force is exerted on the button.

In at least one other embodiment of the present invention, a button and light pipe assembly is provided. The button and light pipe assembly includes a housing and a unitary button and light pipe mechanism. The housing has a panel and receives a switch and a light source. The unitary button and light pipe mechanism is disposed adjacent to the housing such that the panel is disposed between the unitary button and light pipe mechanism and the switch and light source. The unitary button and light pipe mechanism includes a frame, a first arm, a button, and a light pipe. The frame has an upper surface, a lower surface, and an opening that extends between the upper and lower surfaces. The first arm extends from the frame toward the opening and has a distal end. The button is disposed adjacent to the distal end. The light pipe is disposed adjacent to the frame and has a first end portion disposed below the lower surface and a second end portion disposed above the upper surface. The first arm flexes to permit the button to actuate the switch when sufficient force is applied to the button. The light pipe internally reflects light received by the first end portion toward the second end portion.

In at least one other embodiment, the button and light pipe assembly includes a substrate, a housing, and a unitary button and light pipe mechanism. The substrate has a switch and a light source. The housing receives the substrate and includes a panel having a light pipe aperture and a button post aperture. The unitary button and light pipe mechanism is disposed adjacent to the housing such that the panel is disposed between the unitary button and light pipe mechanism and the substrate. The unitary button and light pipe mechanism includes a frame, first and second cantilever arms, a button, and a light pipe. The frame has an opening, an upper surface, a lower surface, a perimeter surface, and a groove. The groove extends from the perimeter surface toward the opening. The first and second cantilever arms extend generally parallel to each other from the frame into the opening. The first and second cantilever arms each have a distal end. The button extends from the distal ends of the first and second cantilever arms. The button includes a post extending from the button and through the button post aperture toward the switch. The light pipe is at least partially disposed between the button, frame, and first and second cantilever arms. The light pipe has a first end portion that extends through the light pipe aperture and a second end portion that extends from the frame away from the upper surface. The first and second cantilever arms flex to permit the post to actuate the switch when sufficient force is applied to the button. The light pipe internally reflects light received by the first end portion from the light source toward the second end portion to illuminate the second end portion.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
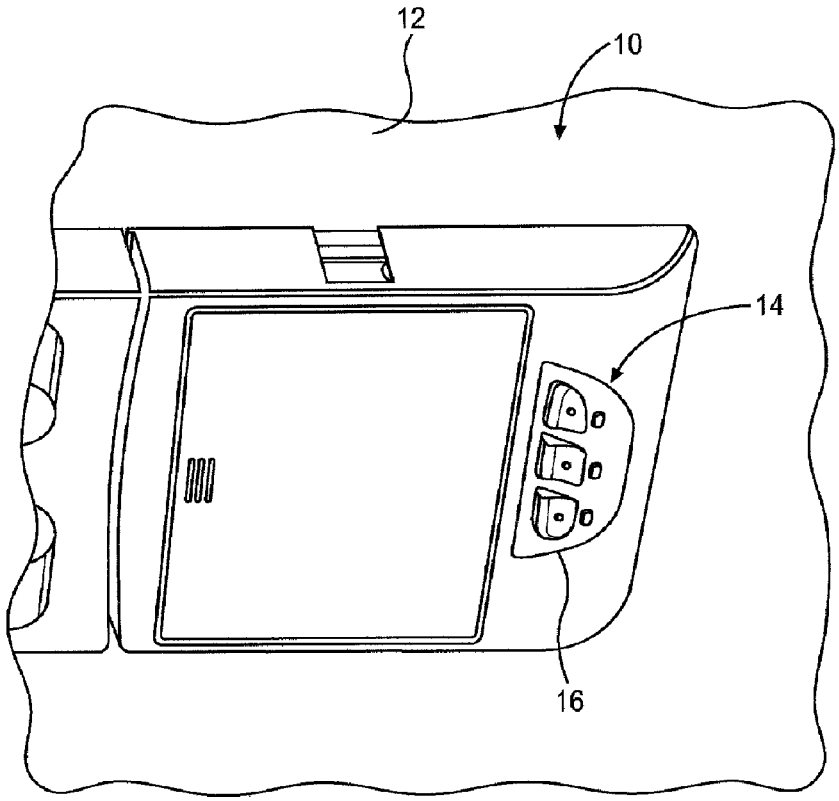
FIG. 1 is a perspective view of an exemplary button and light pipe assembly disposed on an interior trim component of a vehicle.

Referring to FIG. 1, an interior trim component 10 for a vehicle is shown. The interior trim component 10 may be of any suitable type, such as a trim panel like a door module or an instrument panel. In the embodiment shown, the interior trim component 10 is configured as a console that may be disposed proximate a headliner 12 of the vehicle.

The interior trim component 10 may include a button and light pipe assembly 14 for controlling the operation of another device. For example, the assembly 14 may be adapted to remotely control at least one device, such as a garage door opener. Of course, the present invention also contemplates embodiments in which one or more devices are not remotely controlled. For instance, the button and light pipe assembly 14 may be associated with a vehicle electrical system and may be electrically connected to one or more vehicular components.

As shown in FIG. 1, the button and light pipe assembly 14 may be partially concealed by a cover plate or bezel 16. The bezel 16 may include one or more openings through which the buttons and/or light pipes of the assembly 12 may at least partially extend.

Figure 2:
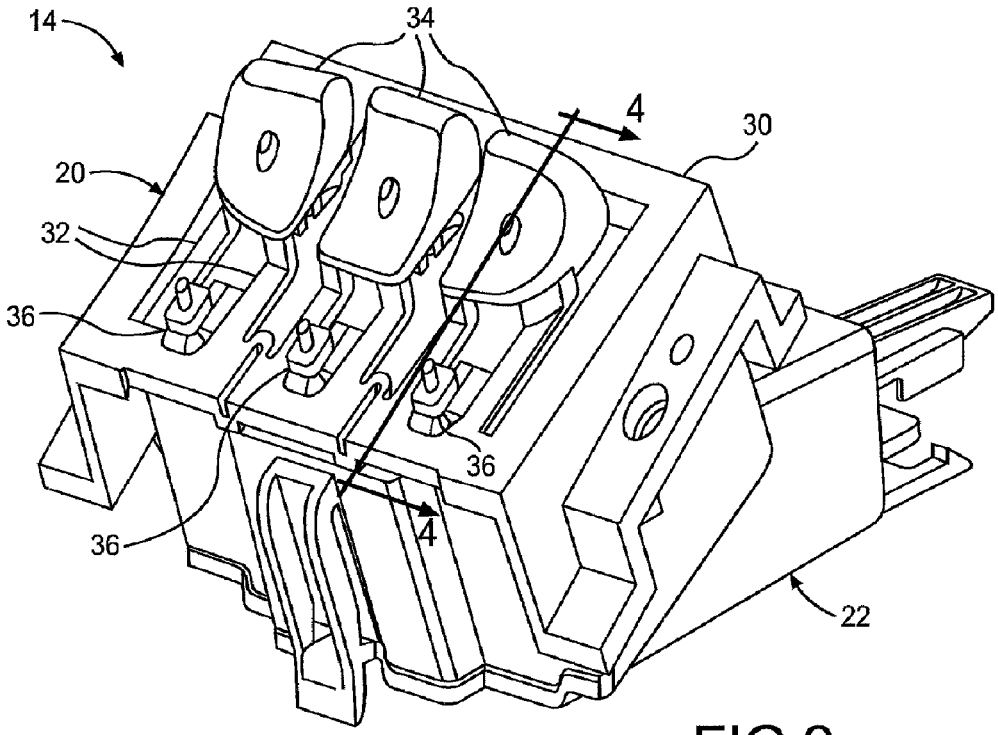
FIG. 2 is a perspective view of the button and light pipe assembly shown in FIG. 1 that includes a unitary button and light pipe mechanism.

Referring to FIG. 2, the button and light pipe assembly 14 is shown in more detail. The button and light pipe assembly 14 may include a button and light pipe mechanism 20 and a housing 22.

The button and light pipe mechanism 20 may be configured as a single, unitary component that may be integrally formed to reduce the number of components and to simplify manufacturing and assembly. The button and light pipe mechanism 20 may be made of polycarbonate or any other suitable material that permits light transmission, has sufficient dimensional stability, and provides flexibility for button actuation as will be described in more detail below.

Optionally, the mechanism 20 may be provided with at least one additional material, such as an additional polymeric material that may be provided on one or more buttons, to provide a softer feel and/or a desired aesthetic appearance.

Figure 3:
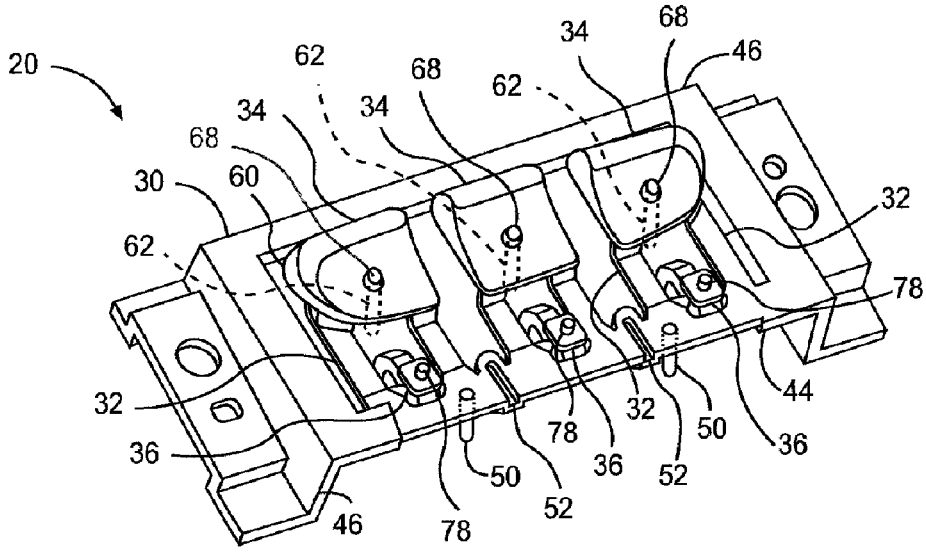
FIG. 3 is a perspective of the unitary button and light pipe mechanism shown in FIG. 2.
Figure 4:
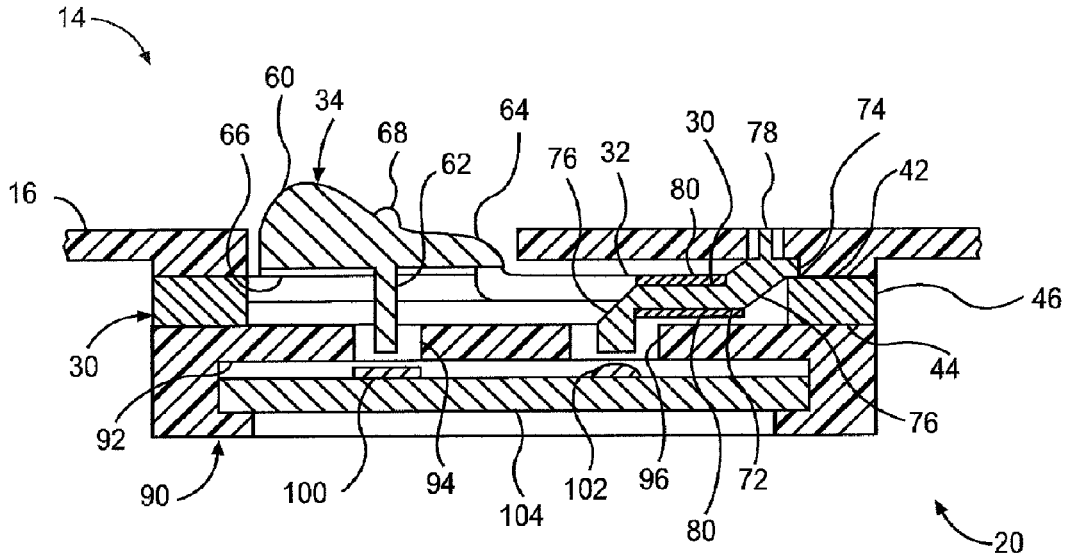
FIG. 4 is a section view of the button and light pipe assembly along section line 4—4 shown in FIG. 2.

Referring to FIGS. 3 and 4, the button and light pipe mechanism 20 is shown in more detail. In the embodiment shown, the button and light pipe mechanism 20 includes a frame 30, one or more arms 32, one or more buttons 34, and one or more light pipes 36.

The frame 30 may have any suitable configuration. For example, the frame 30 may include at least one wall or panel 40 that has an upper surface 42, a lower surface 44 disposed opposite the upper surface 42, and a perimeter surface 46. In addition, the frame 30 may at least partially define an opening 48 that extends between the upper and lower surfaces 42,44. In the embodiment shown, the opening 48 is generally rectangular, but may be provided with any suitable configuration. The frame 30 may also include one or more attachment features that facilitate attachment to the housing 22. In the embodiment shown, the frame 30 includes a plurality of stakes 50 that extend from the lower surface 44 and may be used to heat stake the frame 30 to a component, such as the housing 22. Alternatively, the stakes 50 may be omitted or supplemented with one or more apertures that may receive a fastener for securing the frame 30 to another component. The frame 30 may also be attached to another component in other ways, such as with an adhesive, vibration welding, sonic welding, or with one or more retaining features like a snap tab in various embodiments of the present invention.

The frame 30 may also include one or more grooves 52 that inhibit the transmission of light through the frame 30. For example, at least one groove 52 may be provided that inhibits light transmission from a light source to a light pipe not associated with the light source. As such, a light pipe may be generally isolated from light sources not associated with the light pipe so that the light pipe does not illuminate when a non-associated light source is illuminated. In the embodiment shown in FIG. 3, two grooves 52 are provided that inhibit the transmission of light between three light pipes. More specifically, the grooves 52 inhibit light transmission from a light source associated with the center light pipe to the other light pipes and vice versa. The grooves 52 may have any suitable configuration. For example the grooves 52 may extend from the upper surface 42 toward the lower surface 44 or vice versa and from the perimeter surface 46 toward the opening 48 or vice versa. Optionally, one or more grooves 52 may be provided that extend through the frame 30.

One or more flexible cantilever arms 32 extend from the frame 30. In the embodiment shown, the arms 32 extend from the frame 30 into the opening 48. One or more arms 32 may be associated with a button 34 and may flex when sufficient force is applied to the button 34. The arms 32 may have any suitable configuration. In the embodiment shown in FIG. 3, two generally parallel and planar arms 32 are associated with each button 34. The arms 32 may be provided in various lengths, thicknesses, and configurations to provide a desired amount of flexibility.

The buttons 34 extend from at least one arm 32. In the embodiment shown, three buttons 34 are shown, such that each button 34 extends from a pair of flexible cantilever arms 32. Each button 34 may be associated with a switch as will be described in more detail below. The buttons 34 may have any suitable configuration. In the embodiment shown, each button 34 has a body 60 and a post 62.

The body 60 may be at least partially disposed above the opening 48 and/or the upper surface 42 of the frame 30. The body 60 may have a contoured upper surface 64 and a lower surface 66 disposed opposite the upper surface 64. The upper surface 64 may also include a tactile feature 68 that extends from the upper surface 64. The tactile feature 68 and/or the body 60 may be configured to illuminate or provide backlighting when light is provided. In at least one embodiment, illumination may be provided by a light source not associated with a light pipe.

The post 62 may be adapted to actuate a switch and may extend from the lower surface 66 toward the opening 48. The post 62 may have any suitable configuration. In the embodiment shown, the post 62 is generally linear and extends through the opening 48. In at least one embodiment, the post 62 may be omitted and the body 60 may actuate or trigger the switch.

The one or more light pipes 36 are adapted to internally reflect light. In the embodiment shown, each light pipe 36 is associated with a light source as will be described in more detail below. The light pipes 36 may have any suitable configuration. In the embodiment shown, each light pipe 36 includes a first end portion 70, a connecting portion 72, and a second end portion 74. Of course, the present invention also contemplates numerous other configurations as well as embodiments in which one or more of these portions are omitted. For instance, a light pipe 36 may be provided that has a generally linear configuration.

The first end portion 70 may be adapted to receive light from an associated light source. In the embodiment shown, the first end portion 70 is at least partially disposed between an associated button 34 and the frame 30 and extends below and generally perpendicular to the lower surface 44 of the frame 30. The first end portion 70 may also extend through a light pipe aperture in the housing 22 as will be described in more detail below. In addition, the present invention also contemplates embodiments in which the first end portion 70 is omitted and light is provided directly to the connecting portion 72.

The connecting portion 72 may also have any suitable configuration. In the embodiment shown, the connecting portion 72 is integrally formed with and disposed between the first and second end portions 70,74. The connecting portion 72 may be disposed at least partially within the opening 48 and may be generally disposed between the frame 30 and an associated button 34. The connecting portion 72 may include one or more reflecting surfaces 76 that are configured to reflect light from the first end portion 70 through the connecting portion 72 and to the second end portion 74. In the embodiment shown, each reflecting surface 76 is disposed at an angle relative to an adjacent end portion 70,74. The reflecting surfaces 72 may be disposed at any suitable angle, such as approximately 45° in at least one embodiment of the present invention.

The second end portion 74 may be illuminated by light received from the connecting portion 72. In the embodiment shown, the second end portion 74 is integrally formed with the frame 30 and may extend from an end of the connecting portion 72 disposed opposite the first end portion 70. In at least one embodiment, the second end portion 74 may extend at least partially above the upper surface 42 of the frame 30. The second end portion 74 may also include a protrusion 78 that extends from the second end portion 74. The protrusion 78 may extend at least partially through an associated hole in the bezel 16 as is best shown in FIG. 4.

Optionally, one or more light pipes 36 may also include a masking portion 80 for inhibiting the transmission of light.

The masking portion 80 may be disposed on an exterior surface of the light pipe 36, such as a surface of the connecting portion 72, or another surface that does not receive light from the light source or is designed to illuminate, such as the protrusion 78. The masking portion 80 may be provided as a surface treatment, such as a coating like paint or an elastomer, or a surface finish that at least partially inhibits light transmission out of the light pipe 36.

Referring to FIGS. 2 and 4, an exemplary housing 22 is shown. The housing 22 may have any suitable configuration and may be made of any suitable material, such as a polymeric material like polypropylene. The housing 22 may define a cavity 90 and may include at least one panel 92 and one or more openings. For example, the panel 92 may include one or more button post openings 94 that are associated with one or more buttons 34 and one or more light pipe openings 96 that are associated with one or more light pipes 36. In the embodiment shown, separate button post openings 94 and light pipe openings 96 are associated with each button and each light pipe, respectively. Alternatively, a single opening may be provided that is associated with one or more buttons 34 and/or one or more light pipes 36. The button post openings 94 and light pipe openings 96 may be spaced apart from associated button posts 62 and light pipes 36 to provide clearance to facilitate alignment and assembly.

One or more switches 100 and one or more light sources 102 may be disposed proximate the housing 22. Each light source 102 may be configured to illuminate when an associated switch 100 is actuated. In the embodiment shown, a plurality of switches 100 and light sources 102 are disposed on a substrate 104, such as a circuit board, that is disposed in the cavity 90. The switches 100 may be of any suitable type, such as a mechanical switches, proximity switches or combinations thereof. Similarly, the light sources 102 may be of any suitable type, such as a light emitting diode (LED), incandescent bulb, or combinations thereof. Alternatively, the switches 100 and light sources 102 may be provided as separate components that are not disposed on a substrate 104 in at least one embodiment of the present invention. If a substrate 104 is provided, it may be attached to the housing 22 in any suitable manner, such as with one or more retaining features or an adhesive. Moreover, the substrate 104 may include electronics for controlling and/or communicating with another component, such as a garage door opener.

The button and light pipe assembly 14 may be assembled in any suitable manner. For example, the button and light pipe mechanism 20 and the housing 22 may be positioned in a fixture to facilitate alignment and to permit the button posts 62 and first end portions 70 to extend toward or at least partially through associated button post openings 94 and light pipe openings 96, respectively. The substrate 104 may be installed in the housing 22 such that the switches 102 and light sources 104 are aligned with associated buttons 34 and light pipes 36, respectively. In addition, the button and light pipe assembly 14 may be disposed proximate or assembled to the bezel 16 such that the buttons 34 and protrusions 78 extend toward or at least partially through associated holes in the bezel 16. Moreover, the buttons 34 and protrusions 78 may also be spaced apart from the associated holes in the bezel 16 to facilitate alignment and assembly.

The present invention permits a button and light pipe mechanism and/or a button and light pipe assembly to be provided with fewer individual components, thereby reducing manufacturing and assembly costs as well as the complexity associated with handling and assembling small individual components, such as buttons and light pipes. In addition, the present invention allows various features to be provided on at least one unitary part to establish reliable feature orientation and alignment. Moreover, in at least one embodiment of the present invention, light pipes may be optically isolated from other light pipes and/or light sources, thereby providing desired illumination and visual feedback to the user.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A button and light pipe mechanism comprising:

a unitary body including:

a frame that at least partially defines an opening, a first arm extending from the frame toward the opening, the first arm having a distal end, a button extending from the distal end, and a light pipe extending from the frame and disposed at least partially in the opening between the button and the frame;

wherein the first arm is configured to flex when sufficient force is exerted on the button.

2. The button and light pipe mechanism of claim 1 wherein the button further comprises an upper surface, a lower surface disposed opposite the upper surface, and a post extending from the lower surface into the opening.

3. The button and light pipe mechanism of claim 1 wherein the unitary body further comprises a second arm extending from the frame toward the opening and spaced apart from the first arm, the second arm having a distal end disposed adjacent to the button.

4. The button and light pipe mechanism of claim 3 wherein the light pipe is disposed between the first and second arms.

5. The button and light pipe assembly of claim 3 wherein the first and second arms are disposed generally parallel to each other and are configured to flex to allow the button to move toward the opening when sufficient force is exerted on an upper surface of the button.

6. The button and light pipe mechanism of claim 1 wherein the light pipe further comprises a first end portion disposed below the opening and configured to receive light from a light source and a second end portion having a protrusion that extends above the frame, wherein the light pipe internally reflects light received through the first end portion to the second end portion to illuminate the protrusion.

7. The button and light pipe mechanism of claim 6 wherein at least a portion of the light pipe disposed between the first and second end portions includes a masking portion disposed on an exterior surface that inhibits the transmission of light through an exterior surface of the light pipe.

8. The button and light pipe mechanism of claim 1 wherein the frame further comprises a groove that inhibits light from being reflected through at least a portion of the frame.

9. A button and light pipe assembly comprising:

a housing that receives a switch and a light source, the housing having a panel;

a unitary button and light pipe mechanism disposed adjacent to the housing such that the panel is disposed between the unitary button and light pipe mechanism and the switch and light source, the unitary button and light pipe mechanism including:

a frame having an upper surface, a lower surface, and an opening that extends between the upper and lower surfaces, a first arm extending toward the opening and having a distal end, a button disposed adjacent to the distal end, and a light pipe disposed adjacent to the frame and having a first end portion disposed below the lower surface and a second end portion disposed above the upper surface;

wherein the first arm flexes to permit the button to actuate the switch when sufficient force is applied to the button and the light pipe internally reflects light received by the first end portion toward the second end portion.

10. The button and light pipe assembly of claim 9 wherein the panel further comprises a first aperture and the button further comprises a post that extends through the first aperture toward the switch.

11. The button and light pipe assembly of claim 9 wherein the panel further comprises a second aperture and the light pipe extends through the second aperture toward the light source.

12. The button and light pipe assembly of claim 11 wherein the light pipe is spaced apart from the second aperture to facilitate assembly.

13. The button and light pipe assembly of claim 9 wherein the unitary button and light pipe mechanism further comprises first and second light pipes extending from the frame and the frame further comprises a groove disposed between the first and second light pipes that inhibits light transmission from the first light pipe to the second light pipe.

14. The button and light pipe assembly of claim 9 wherein the groove extends from the upper surface toward the lower surface of the frame.

15. The button and light pipe assembly of claim 9 wherein the unitary button and light pipe mechanism further comprises a second arm extending toward the opening and spaced apart from the first arm, the second arm having a distal end disposed adjacent to the button.

16. The button and light pipe assembly of claim 9 further comprising a bezel disposed adjacent to the unitary button and light pipe mechanism.

17. The button and light pipe assembly of claim 16 wherein the first end portion of the light pipe further comprises a protrusion and the bezel further comprises a protrusion aperture through which the protrusion at least partially extends and a button aperture through which the button at least partially extends, the button and protrusion being spaced apart from the button aperture and the protrusion aperture, respectively, to facilitate assembly.

18. The button and light pipe assembly of claim 9 wherein the button further comprises an upper surface and a tactile feature extending from the upper surface, wherein the tactile feature is configured to illuminate.

19. A button and light pipe assembly for a vehicle, comprising:

a substrate having a switch and a light source;

a housing that receives the substrate and includes a panel having a light pipe aperture and a button post aperture;

a unitary button and light pipe mechanism disposed adjacent to the housing such that the panel is disposed between the unitary button and light pipe mechanism and the substrate, the unitary button and light pipe mechanism including:

a frame having an opening, an upper surface, a lower surface, a perimeter surface, and a groove extending from the perimeter surface toward the opening, first and second cantilever arms extending generally parallel to each other from the frame into the opening, the first and second cantilever arms each having a distal end, a button extending from the distal ends of the first and second cantilever arms, the button including a post extending from the button and through the button post aperture toward the switch, and a light pipe at least partially disposed between the button, the frame, and the first and second cantilever arms, the light pipe having a first end portion extending through the light pipe aperture and a second end portion extending from the frame away from the upper surface;

wherein the first and second cantilever arms flex to permit the post to actuate the switch when sufficient force is applied to the button and the light pipe internally reflects light received by the first end portion from the light source toward the second end portion to illuminate the second end portion.

20. The button and light pipe assembly of claim 19 wherein the unitary button and light pipe assembly is made of polycarbonate.

* * * * *